US005487675A

United States Patent [19]

Daoud

[11] Patent Number: 5,487,675

[45] Date of Patent: Jan. 30, 1996

[54] INTEGRATED PROTECTOR AND MODULAR JACK

[75] Inventor: Bassel Hage Daoud, Parsippany Township, Morris County, N.J.

[73] Assignee: AT&T Corp., Murray Hill, N.J.

[21] Appl. No.: 311,987

[22] Filed: Sep. 26, 1994

[51] Int. Cl.[6] ..... H01R 13/74; H01R 13/648

[52] U.S. Cl. ..... 439/95; 379/328

[58] Field of Search ..... 439/95–97, 108, 439/620, 49, 709; 379/325–332, 379, 387, 399, 433, 442

[56] References Cited

U.S. PATENT DOCUMENTS 5,363,440 11/1994 Daoud ..... 439/95

*Primary Examiner*—Gary F. Paumen

*Attorney, Agent, or Firm*—Lester H. Birnbaum

[57] ABSTRACT

Disclosed is a network interface unit where the protectors are mounted within a pouch attached to an RJ11 modular jack. The modular jack includes a contact member which electrically contacts a grounding strip on the terminal chassis to provide the necessary ground connection for the protector.

13 Claims, 2 Drawing Sheets

INTEGRATED PROTECTOR AND MODULAR JACK

BACKGROUND OF THE INVENTION

This invention relates to telecommunications apparatus and, in particular, to network interface units.

Network interface units constitute the demarcation between the customer's equipment and the telephone network. In buildings including multiple subscribers, the interlace unit is typically mounted in the basement and includes an array of customer bridges, each bridge being coupled to an individual subscriber line. The bridges are coupled to the phone network through an RJ11 jack and plug so that a customer can plug a working phone into the jack to determine if any equipment problems lie in the customer or network side of the telecommunications system.

Network interface units also include a building entrance protector portion which includes a cable splice chamber and a protector field for providing surge protection for each customer. The protector field is typically mounted adjacent to the array of customer bridges. (See, e.g., U.S. Pat. No. 4,945,560 issued to Collins et al.) It has recently been proposed to include the protector field and splice chamber in the bottom layer of a multilayer unit with the customer bridges in the top layer. (See U.S. patent application of Daoud, Ser. No. 08/040,772, filed Mar. 31, 1993, and assigned to the present assignee.)

It has also been suggested to include a housing attached to the RJ11 jack of a customer bridge, which housing could include a protector, a maintenance termination unit, or other types of electronic components. (See U.S. Pat. No. 5,222,908 issued to Baker, et al.) Suggestions have also been made to combine a modular jack and protector in a single housing. (See, e.g., U.S. Pat. No. 5,025,345 issued to Marks.) Further, it has been proposed to include a shield contact on a modular jack. The shield includes tails for mounting to a ground plane of a printed wiring board. (See U.S. Pat. No. 4,878,858 issued to Dechelette.)

SUMMARY OF THE INVENTION

The invention, in one aspect, is a network interface unit for servicing a multiplicity of subscribers. The unit comprises a chassis including a conductive portion with a first array of apertures therein, the portion including conductive members extending from a major surface of the portion on at least one edge of each aperture of the first array. The unit further includes a plurality of customer bridge assemblies, each including a jack and a housing mechanically coupled thereto with a protector included in the housing. Attached to the jack is a contact member with at least one contact finger extending from at least one side and electrically coupled to a ground contact of the protector. The jacks are inserted into corresponding first apertures so that the contact fingers make electrical contact with corresponding conductive members extending from the conductive portion.

In accordance with another aspect, the invention is a customer bridge assembly which includes a jack adapted for mounting in an aperture of a chassis, and a housing mechanically attached to the jack. The housing includes therein a protector comprising a ground contact. A contact member electrically coupled to the protector ground contact is attached to the jack. The contact member includes at least one contact finger extending from at least one side and adapted to make electrical contact with a conductive member extending essentially perpendicular to a major surface of the chassis.

BRIEF DESCRIPTION OF THE DRAWING

These and other features of the invention are described in detail in the following description. In the drawing.

DETAILED DESCRIPTION

Figure 1:
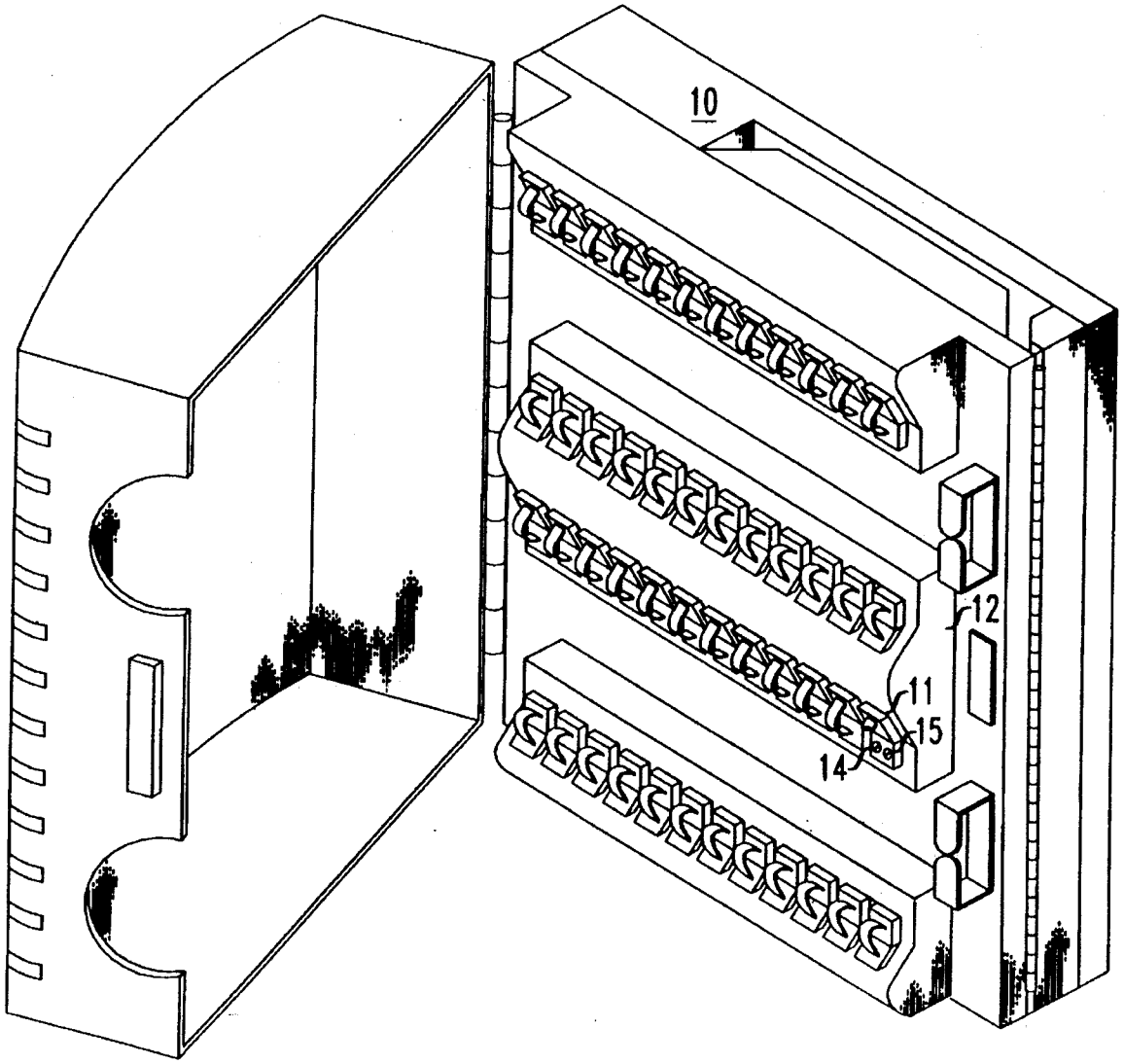
FIG. 1 is a perspective view of a network interface unit in accordance with an embodiment of the invention.

A typical interface unit, 10, is shown in plan view in FIG. 1. The unit includes an array of customer bridges, e.g., 11, mounted within respective apertures in a chassis, 12. The chassis is typically made of aluminum.

Figure 2:
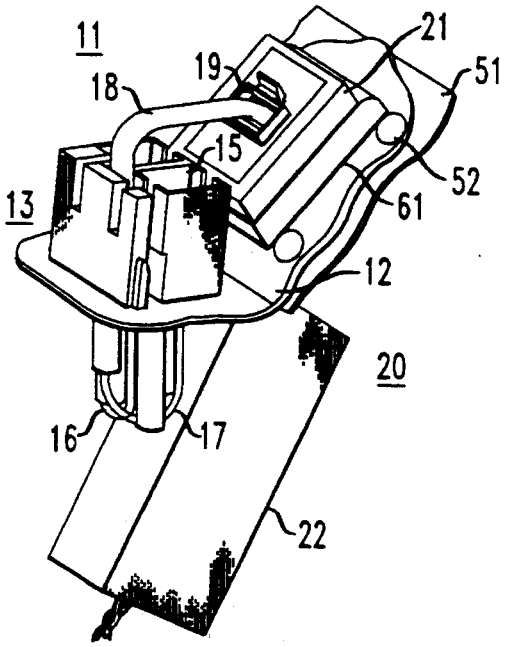
FIG. 2 is an enlarged, partly cut-away view of a portion of the unit of FIG. 1.
Figure 3:
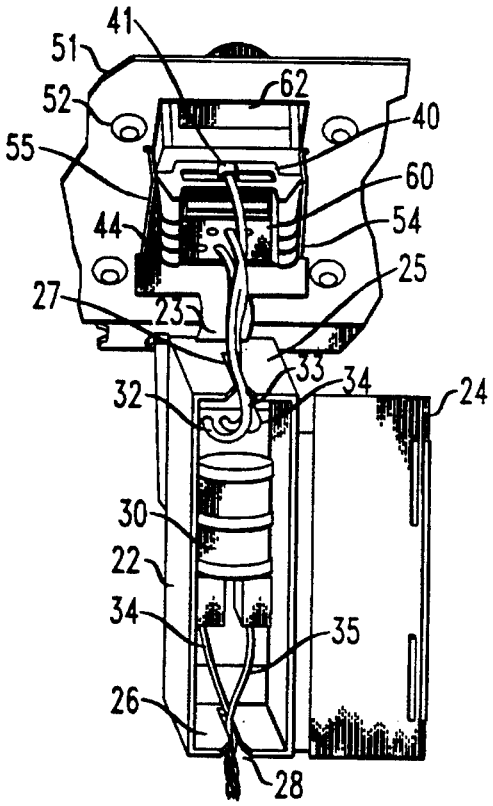
FIG. 3 is another view of the portion of the unit shown in FIG. 2.

One of the bridges, 11, is shown in more detail in the views of FIGS. 2 and 3. As best seen in FIGS. 1 and 2, each bridge includes a connector portion, 13, which comprises a pair of screws, 14 and 15, electrically coupled to the customer's equipment by means of wires (not shown). The screws, 14 and 15, are also electrically coupled to a pair of wires, 16 and 17, formed within a protective jacket, 18, which emerges from the body of the connector portion, 13. The wires terminate in a standard RJ11 plug, 19. (For a more detailed discussion of a connector portion which may be used in a network interlace unit, see U.S. Pat. No. 5,004,433 issued to Daoud.)

Adjacent to each connector portion, 13, is a bridge assembly, 20, which includes a jack, 21, for receiving the RJ11 plug, 19. As best seen in the view of FIG. 3, mechanically attached to the jack, 21, by means of a flexible hinge, 23, is a housing, 22. The housing, 22, includes a hinged cover, 24, and a pair of sidewalls, 25 and 26, each sidewall including a slot, 27 and 28, respectively. The housing, 22, and jack, 21, are typically molded from a single piece of material such as plastic.

Included within the housing, 22, is a standard solid state surge protector, 30, such as AT&T's 3C1S surge protector. The protector, 30, is mounted to a circuit board, 31, and is electrically connected in parallel with the tip and ring wires, 32 and 33, from the jack, 21, and the tip and ring wires, 34 and 35, going to the telephone network. As shown, the tip and ring wires pass through respective slots, 27 and 28, in the sidewalls of the housing.

Figure 4:
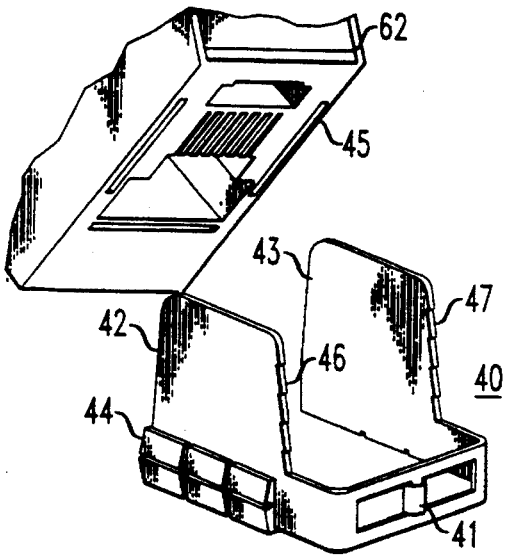
FIG. 4 is an exploded, perspective view of a portion of the unit shown in FIGS. 2 and 3.

The ground connection of the protector, 30, is provided by means of a wire, 34, extending from a pad (not shown) on the board connected to the ground terminal of the protector. The opposite end of this wire, 34, is electrically coupled to a contact member, 40, which is mechanically attached to the surface of the jack, 21. The combination of the jack, 21, and contact member, 40, is illustrated in the exploded view of FIG. 4.

The contact member, 40, includes a terminal, 41, for receiving the ground wire, 34, from the protector, 30. The contact member, 40, further includes a pair of sidewalls, 42 and 43. Extending upward from the bottom of each sidewall, e.g., 42, is at least one and preferably a plurality of contact fingers, e.g., 44. (It will be noted that the contact fingers extending from the sidewall 43 are not visible in the view of FIG. 4, but can be seen partially in the view of FIG. 3.) The sidewalls 42 and 43 are inserted into slots, e.g., 45, in the jack, 21, so that the contact member, 40, is securely attached thereto. In order to resist pull-out, the rear edges, 46 and 47, of the sidewalls are serrated. The contact member is preferably made from a single piece of metal such as phosphor bronze or beryllium copper.

Figure 5:
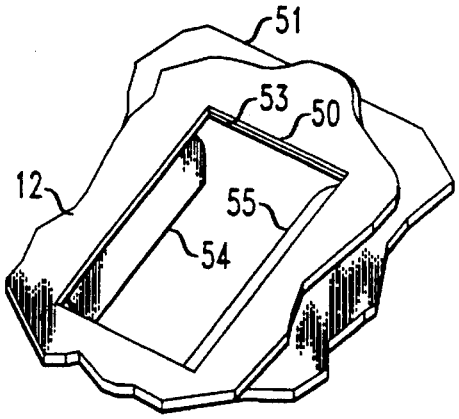
FIG. 5 is a perspective view of a portion of the unit of FIG. 1 with customer bridge assembly removed.

The chassis, 12, includes a series of apertures for receiving the bridge assemblies, 20. One of these apertures is illustrated as 50 in FIG. 5. As also shown in FIG. 5, as well as in FIGS. 2 and 3, a flat metal sheet, 51, is attached to the bottom major surface of the chassis by means of, for example, flat head rivets, e.g., 52. Typically, a single sheet will be provided for each row of bridge assemblies in the unit, 10. The sheet, 51, is electrically coupled to ground potential. The sheet, 51, includes a series of apertures, e.g., 53, which are aligned with corresponding apertures, e.g., 50, in the chassis. The apertures, 53, in the sheet, 51, are formed so that portions of the sheet extend downward from the major surface of the chassis to form conductive members, 54 and 55, on two sides of the aperture, 53, in this example extending essentially perpendicular to the surface of the chassis. (See also FIG. 3.) The conductive members, 54 and 55, could be formed on any number of sides according to particular needs. The conductive members, 54 and 55, typically extend approximately 1.3 cm from the major surface of the sheet, 51.

Once the protector, 30, is inserted in the housing, 22, the contact member, 40, is attached to the jack, 21, the tip and ring wires, 32 and 33, are coupled to the pins (not shown) of the jack, 21, through the plastic insert, 60, and the ground wire, 34, is coupled to the terminal, 41, of the contact member, 40, the bridge assembly is ready for insertion into the apertures, 50 and 53, in the chassis and ground sheet, respectively. This is accomplished by first inserting the housing, 22, through the apertures, 50 and 53. The flexible hinge, 23, will ensure that the housing follows the contours of the chassis, 12. A ledge, 61, on the outer surface of the jack, 21, will make contact with the surface of the chassis to prevent any further movement through the apertures. At the same time, a latch, 62, on the jack housing will engage the top edge of the aperture, 53, in the sheet, 51, to secure the jack, 21, in the aperture.

It will be noted that when the jack is secured in the apertures, 50 and 53, the contact fingers, e.g., 44, of the contact member, 40, will electrically and mechanically contact the conductive members, e.g., 55, of the sheet, 51. Thus, a ground connection is provided for the protector, 30, through the wire, 34, the contact member, 40, and the sheet, 51.

It will be appreciated that by integrating the protector into the bridge assembly, the need for a separate protector field is eliminated, and considerable cost reductions are realizable.

Various modifications will become apparent to those skilled in the art. For example, although a separate conductive sheet, 51, is described for providing a ground connection, the chassis body, 12, itself may provide the ground connection if it is made of a sufficiently conductive material. All such variations which basically rely on the teachings through which the invention has advanced the art are properly considered within the scope of the invention.

I claim:

1. A network interface unit for servicing a multiplicity of subscribers comprising:

a chassis including a conductive portion with a first array of apertures therein, the portion including conductive members extending from a major surface of the portion on at least one edge of each aperture of the first array;

a plurality of customer bridge assemblies each including a jack and a housing mechanically coupled thereto with a surge protector included in the housing; and contact members attached to each jack, each of said contact members including at least one contact finger extending from at least one side and electrically coupled to a ground contact of the protector, the jacks being inserted into corresponding ones of said first apertures so that the contact fingers make electrical contact with corresponding ones of said conductive members extending from the portion.

2. A unit according to claim 1 wherein the conductive portion comprises a conductive sheet attached to a surface of the chassis, and the chassis includes a second array of apertures aligned with the first array of apertures in the conductive sheet.

3. A unit according to claim 2 wherein the conductive members comprise portions of the conductive sheet which are folded at the edges of the first array of apertures.

4. A unit according to claim 1 wherein the protector is a solid state protector mounted to a circuit board and the ground contact includes a wire electrically coupled to the contact member.

5. A unit according to claim 2 wherein the conductive sheet is attached to a surface of the chassis which is opposite to the surface on which the jacks are mounted.

6. A unit according to claim I wherein each jack includes at least one slot and each contact member includes at least one side wall inserted into the slot, said sidewall including a serrated edge.

7. A unit according to claim 6 wherein the contact finger of the contact member extends from a bottom edge of the sidewall.

8. A customer bridge assembly comprising:

a jack adapted for mounting in an aperture in a chassis;

a housing mechanically attached to the jack, the housing including a surge protector with a ground contact therein; and a contact member electrically coupled to the ground contact and attached to the jack, the contact member including at least one contact finger extending from at least one side of the member and adapted to make electrical contact with a conductive member extending essentially perpendicular to a major surface of the chassis.

9. An assembly according to claim 8 wherein the jack includes at least one slot and the side of the contact member is inserted into the slot.

10. An assembly according to claim 9 wherein the side includes a serrated edge.

11. An assembly according to claim 8 wherein the contact finger extends from a bottom edge of the side of the member.

12. An assembly according to claim 8 wherein the contact member further includes means for receiving a ground wire from the protector.

13. An assembly according to claim 8 wherein the jack and housing are attached by a flexible hinge.

* * * * *